US005993322A

United States Patent [19]

Consalvi

[11] Patent Number: 5,993,322

[45] Date of Patent: Nov. 30, 1999

[54] GOLF PRACTICE RANGE

[76] Inventor: Gary J. Consalvi, 1016 Seminole Creek Dr., Oviedo, Fla. 32765

[21] Appl. No.: 09/064,453

[22] Filed: Apr. 22, 1998

[51] Int. Cl.[6] ..... A63B 69/36

[52] U.S. Cl. ..... 473/168

[58] Field of Search ..... 473/168–171, 473/150

[56] References Cited

U.S. PATENT DOCUMENTS 3,649,025 3/1972 Garland .
3,797,827 3/1974 Child .
5,092,600 3/1992 Ruth, Jr. et al. .
5,163,677 11/1992 Foley .
5,219,161 6/1993 Williams, Sr. .

*Primary Examiner*—Mark S. Graham
*Attorney, Agent, or Firm*—Rhodes & Mason, PLLC

[57] ABSTRACT

A golf driving range for use with floating balls including a water reservoir having a front edge, a rear edge, and two side edges; a plurality of practice tees along the front edge; a plurality of island greens in the reservoir; a pump system adjacent an edge of the reservoir to pump water onto the surface of water in the reservoir, the pump system including a pump, a water inlet conduit extending into the reservoir, and at least one water outlet conduit extending toward the reservoir; and a ball retriever adjacent an edge of the reservoir on the opposite side of the reservoir from the pump system, the water outlet conduit being positioned to project water substantially parallel to the surface of water in the conduit and generally in the direction of the ball retriever, whereby balls floating in the reservoir float toward, and are retrieved by, the ball retriever.

19 Claims, 2 Drawing Sheets

GOLF PRACTICE RANGE

BACKGROUND OF THE INVENTION (1) Field of the Invention

The present invention relates generally to a golf practice range or driving range, and in particular to a golf practice range in which floating golf balls are hit towards island-type greens spaced within a body of water.

(2) Description of the Prior Art

Golf practice or driving ranges are frequently used by both amateur and advanced golfers to improve their golfing skills, as well as a convenient form of recreation. Generally such ranges are comprised of a land area or earthen fairway onto which golf balls are hit that extends outwardly from a front side edge for 300 yards or more. The width of the land area will differ from facility to facility, depending upon the number of players accommodated by the facility at a given time, and limitations imposed by adjacent properties.

The range includes a plurality of practice stations or tees aligned along the front side of the land area for use by the golfers. Each station includes a tee or mat upon which ball are placed. In more sophisticated ranges, each station may also include a device for feeding balls to each practice tee. The range may also include netting or other type of screens along one or more of the edges of the land surface to prevent incorrectly hit balls from escaping from the driving range.

The land area will normally include signs positioned at given distances from the practice stations, e.g., every 50 yards, to enable the golfer to determine the distance a ball is hit. In addition, the area may include flags positioned at various locations to simulate the greens of a regular golf course, so that the golfer can practice hitting toward a green. In order to retrieve golf balls hit into the area, a cart that includes a collection device is periodically driven over the area to collect balls from the surface. The collection device may be, for example, a rotary brush that brushes the balls into a container. After collection, the balls are returned to the play station area for reuse by the golfers.

Variations on this broad theme have been suggested by the prior art. For example, U.S. Pat. No. 3,649,025 to Garland and U.S. Pat. No. 3,797,827 to Child, describe golf driving ranges that use a body of water instead of the above-described land area at the area into which balls are hit. In the ranges described in these patents, balls are hit into the water from play stations located along an edge of the lake or other body of water. The balls then sink to the bottom of the body of water, and are collected by a net or conveyor system that conveys the balls back to the play station area.

U.S. Pat. No. 5,163,677 to Foley describes a golf driving range that includes a man-made pond with a green positioned in the pond. Balls hit into the pond roll down an inclined surface at the bottom of the pond to a collection area where the balls are ejected into a collection basket.

Despite the number of driving range designs that now exist, there is still a need for a golf practice or driving range that offers the golfer the opportunity to hit balls toward green-type areas in an aesthetically pleasing environment. From the ease of operation, a facility providing for the ease of ball retrieval would be highly useful.

SUMMARY OF THE INVENTION

The present invention relates to a golf driving range played with floating golf balls. In general, the driving range is comprised of a man-made pond or water reservoir to serve as a fairway, a plurality of islands or greens positioned within the reservoir, a plurality of play stations or practice tees positioned along one side of the reservoir, and a means for retrieving balls hit into the basin or onto the greens. Other optional features of the driving range may include practice greens, practice sand traps, a concession stand, a pro shop, etc.

The man-made reservoir can vary in size and shape, depending upon the overall design of the driving range. The practice tees are positioned along one edge of the reservoir, referred to herein as the front edge. This edges may be straight or curved, depending on the design. The distance between the front edge and the opposite edge of the reservoir, i.e., the back edge, will normally be from about 250 to about 300 yards, although lesser distances can be used if a net or other ball retainer is extended upwardly from the back edge. The outer ends of the front edge are joined with the outer ends of the back edge with opposed side edges. Normally, these side edges will be from about 100 to about 150 yards apart, although the distance will vary if the front and back edges are of different lengths. Nets may also be positioned to extend upwardly from the side edges, especially near the front edge, to prevent ball from being driven out of the driving range area.

The depth of the reservoir is not critical, and will normally be of sufficient depth so that the bottom of the reservoir will not be readily visible when the reservoir is filled with water. The depth can be decreased by painting the bottom of the reservoir a dark color. Normally, the reservoir will be from about 3.5 to about 5 feet deep.

A plurality of islands or greens positioned within the reservoir act as targets for the players. Each island is comprised of an upper surface surrounded by a closed periphery, which may be irregular or of a particular shape. A pin comprised of a flag and a ball-receiving cup may be positioned at some location on the green. The upper surface of the green may be inclined so that balls hit onto the green will roll off of the surface. The islands may be fixed at a given location, or at least one of the greens b may be moveable.

The exact configuration of the practice tees is not critical to the invention, and various designs available from the prior art may be used. Normally, the practice tees will include a horizontal surface upon which the player stands, with a golf mat being place on the surface for use in positioning the ball. The practice tees may be separated from each other by walls or other separators. One or more ball dispensers may be placed in the vicinity of the practice tees. As will be described herein in detail, these ball dispensers may be in communication with a ball retrieval mechanism to return balls to the players.

A unique feature of the present invention resides in the use of the above reservoir, instead of a normal earthen fairway, in combination with floating golf balls that remain on the surface of water in the reservoir after being hit into the reservoir. Additional, the present invention uniquely provides a means for retrieving golf balls from the reservoir.

As noted previously, balls hit onto the earthen fairway of a conventional driving range are normally collected with a vehicle that traverses the fairway surface to collect balls into a receptacle that is then emptied at the control booth of the driving range. In prior art driving ranges using a lake or other body of water as a fairway, the balls sink to the bottom of the body of water and then roll, or are conveyed by moving surfaces, back to the tee area.

The present invention provides for a floating ball handling system that is comprised of a pump to move the water on the upper surface of the reservoir, and balls floating thereon, to a ball receiver where the balls are separated from the water. The system may also include a ball washer for washing the balls prior to their reuse, and a conveyor for moving the balls to the aforementioned ball dispensers adjacent the tee area.

The pump is generally comprised of a housing enclosing a motor that rotates a screw or other water conveying mechanism, a water inlet into the housing, and at least one water outlet through which water is discharged from the housing. One or more of the water outlets may be adjustable to alter the direction in which the water is discharged.

The ball receiver is comprised of a housing including an inlet for receiving balls and a flow of water from the reservoir, and an outlet for returning water to the reservoir. A screen or other ball separator is positioned between the inlet and outlet, and a ball receiver is positioned to receive balls after they are separated from the water by the ball separator. The ball receiver may be, for example, a receptacle for holding the balls, or a conduit or conveyor for transporting the balls to another part of the system.

For example, the balls, after being separated from the reservoir water, can be transported to a ball washer, which may be of conventional design, where a turbulent stream of water, which may contain a detergent, removes any dirt or debris from the balls. After washing, the balls may be dried and stored in a receptacle. Alternatively, the balls may be conveyed to ball dispensers of a conventional design where they can be accessed by players. For example, the ball dispenser may be a coin operated dispenser that, upon insertion of the required coins or currency, dispenses a given number of balls, or feeds the balls directly to the practice tee.

The water pumping system is preferably located near the rear edge of the reservoir, while the ball receiver is preferably located near the front edge of the reservoir. For example, the pump housing may be positioned at the intersection of the rear edge and one side edge of the reservoir, while the ball receiver is positioned at the at the intersection of the front edge and the opposite side edge of the reservoir. Discharge outlets of the pump system may be located at the pump housing or at a point along the rear or a side edge. Also, a plurality of discharge outlets may be located along the rear and/or side edges of the reservoir and directed to create a smooth flow of the surface of the reservoir, and balls carried thereon, to the ball receiver.

In operation, balls are hit from the practice tees into the reservoir area. Balls landing in the water float on the water's surface. During play, the pump system causes the upper surface of the water to flow in the direction of the ball receiver, thereby causing the floating balls and water to enter the ball receiver intake opening. Within the ball receiver, the water and balls are separated. The balls, with or without being first washed, are conveyed to a receptacle or to a dispenser for reuse.

Therefore, it is an aspect of the invention to provide a golf driving range for use with floating balls comprising a water reservoir having a front edge, a rear edge, and two side edges; a plurality of practice tees along the front edge; a plurality of island greens in the reservoir; a pump system adjacent an edge of the reservoir to pump water onto the surface of water in the reservoir; and a ball retriever adjacent an edge of the reservoir on the opposite side of the reservoir from the pump system, whereby balls floating on the water in the reservoir float toward, and are retrieved by, the ball retriever.

It is another aspect of the invention to provide a method of retrieving floating golf balls hit into a body of water having opposite sides that includes the steps of pumping water onto the surface onto one side of the body of water to cause the balls to float to the opposite side of the body of water; and retrieving the balls at the other side of the body of water.

These and other aspects of the invention will be apparent to one skilled in the art after reading the following detailed description of the invention taken with the drawings.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
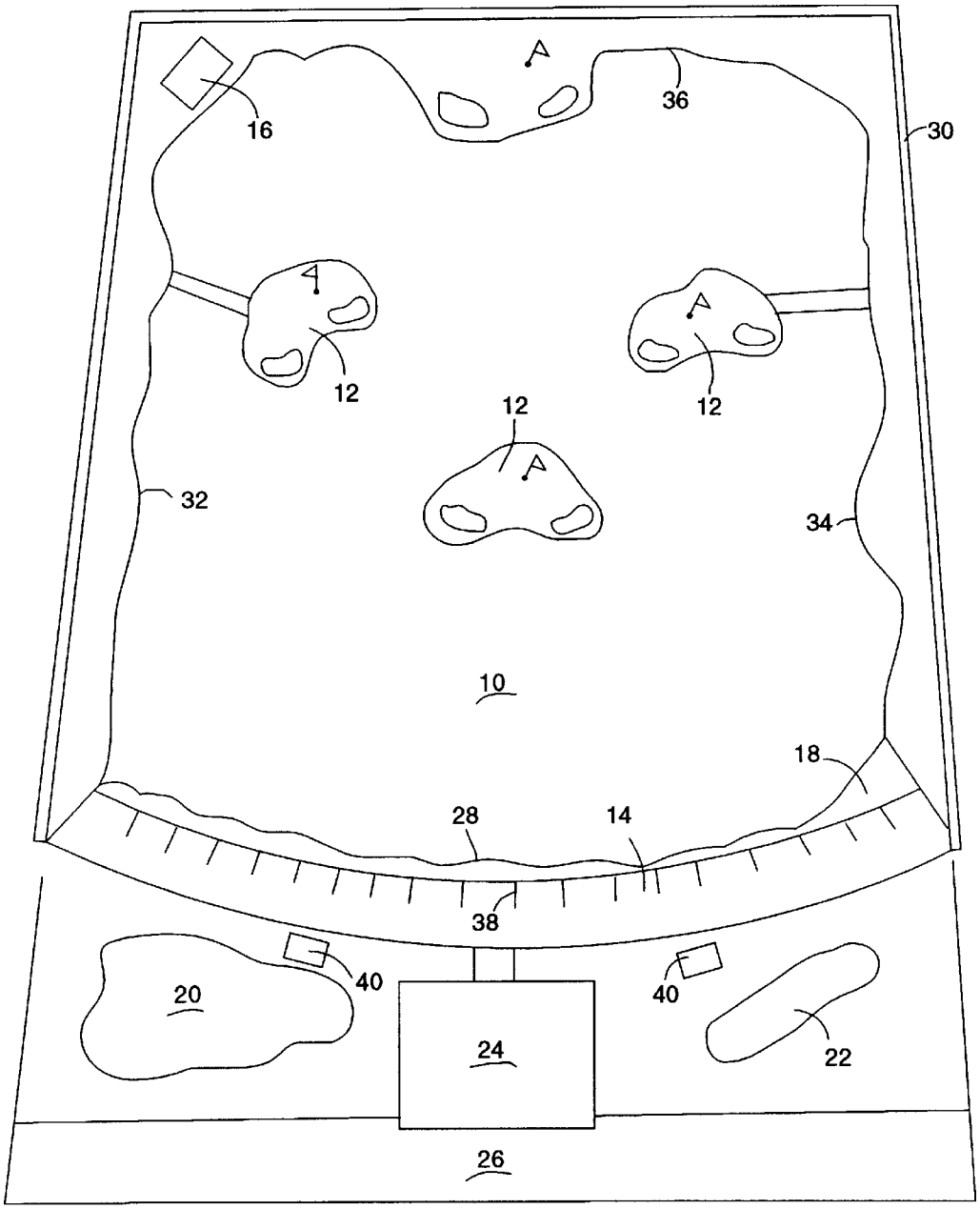
FIG. 1 is an overhead, schematic view of the driving range of the present invention.

As illustrated in FIG. 1, the present invention is comprised of a golf driving range that includes a man-made water reservoir 10, a plurality of island greens 12 positioned within reservoir 10, a plurality of practice tees 14 positioned adjacent reservoir 10, a pump system 16 for causing the surface of water in reservoir to flow in a given direction, and a ball retriever 18 positioned to receive floating golf balls carried by the flowing water. The driving range may include a practice green 20, a practice sand trap 22, a club house 24, a parking area 26, etc.

Practice tees 14 are positioned along the front edge 28 of reservoir 10. A net 30 extends upwardly outside side edges 32 and 34, and rear edge 36, of reservoir 10 to prevent incorrectly hit balls front being driven outside the area of the practice range. Practice tees 14 are separated from each other by separators 38. One or more ball dispensers 40 may be placed in the vicinity of the practice tees.

Figure 2:
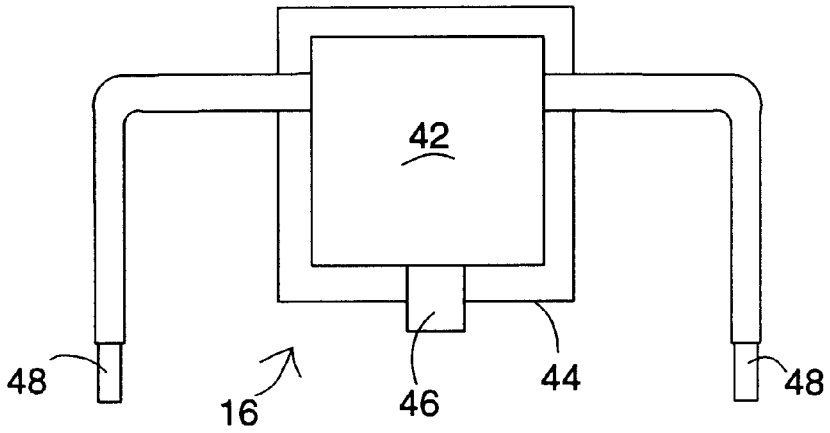
FIG. 2 is a sectional top view of the pumping station.

Pump system 16, illustrated in FIG. 2, is comprised of a water pump 42 enclosed by a housing 44. Pump 42 is connected to a water inlet conduit 46 extending from reservoir 10 into housing 44, and adjustable water outlet conduits 48 which are positioned to discharge water tangentially at or above the surface of water in reservoir 10 in the direction of ball receiver 18.

Figure 3:
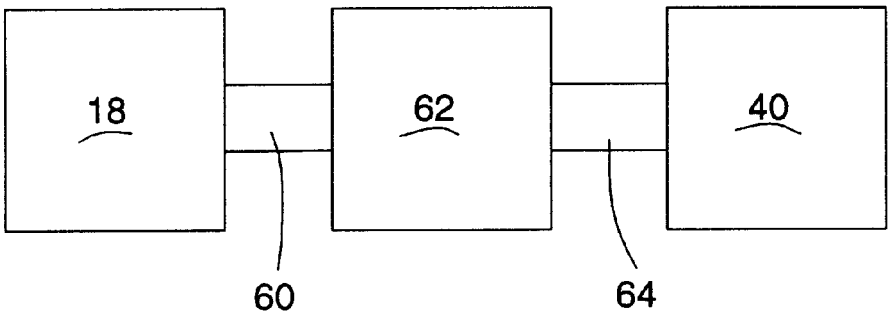
FIG. 3 is a schematic illustration of the ball retrieval system including a ball washer and ball dispenser.
Figure 4:
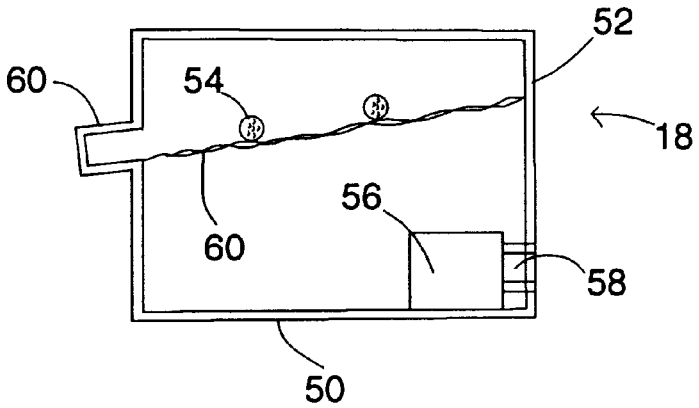
FIG. 4 is a sectional side view of the ball retriever.

Ball receiver 18, illustrated in FIGS. 3 and 4, is comprised of a housing 50 including an inlet 52 for receiving balls 54 and water from the reservoir, and a pump 56 for returning water through outlet 58 to the reservoir 10. A screen 60 extends across housing 50 between inlet 52 and outlet 58, and a ball-receiving conduit 60 is positioned to receive balls 54. Balls 54 can be transported via conduit 60 to ball washer 62, and then via conduit 64 to a ball dispenser 40.

In operation, balls 54 are hit from practice tees 14 onto greens 12 or into reservoir 10. Pump 42 draws water in from the lower part of reservoir 10 through intake conduit 46 and discharges the water at the surface of water in reservoir 10 in the direction of ball retriever 10, cause balls 54 to move toward retriever 18.

At receiver 18, balls 54 and water enter ball inlet 52. Water is separated by screen 60 and pumped back into reservoir 10 through outlet 58 with pump 56. Balls 54 exit retriever 18 through exit conduit 60, and are carried to ball washer 62 where they are washed. The cleaned balls 54 then move through conduit 64 to ball dispenser 40 for reuse.

Certain modifications and improvements will occur to those skilled in the art upon a reading of the foregoing description. Such modifications and improvements have been deleted herein for the sake of conciseness and readability but are properly within the scope of the follow claims.

What is claimed is:

1. A golf driving range for use with floating balls comprising:

a) a water reservoir having a front edge, a rear edge, and two side edges;

b) a plurality of practice tees along said front edge;

c) a plurality of island greens in said reservoir;

d) a pump system adjacent an edge of said reservoir to pump water onto the surface of water in said reservoir; and e) a ball retriever adjacent another edge of said reservoir, whereby balls floating on the water in said reservoir float toward, and are retrieved by, said ball retriever.

2. The driving range of claim 1, wherein said pump system is comprised of a pump, a water inlet conduit extending into said reservoir, and at least one water outlet conduit extending toward said reservoir.

3. The driving range of claim 2, wherein said inlet conduit includes in inlet opening adjacent the bottom of said reservoir.

4. The driving range of claim 2, wherein said water outlet conduit is positioned to project water substantially parallel to the surface of water in said conduit and in generally in the direction of said ball retriever.

5. The driving range of claim 1, further including a ball washer to receive balls from said ball retriever.

6. The driving range of claim 1, further including at least one ball dispenser for dispensing balls received by said ball retriever.

7. The driving range of claim 1, wherein said ball retriever includes an inlet for receiving balls and water from said reservoir, a water discharge outlet for returning water to said reservoir, a separator adapted for separating said balls from said water, and a discharge conduit for discharging balls from said ball retriever.

8. The driving range of claim 1, wherein said pump system is positioned at the intersection of said rear edge and one of said side edges, and said ball retriever is positioned at the intersection of said front edge and the other of said side edges.

9. The driving range of claim 1, wherein said reservoir has a depth of from about 3.5 to about 5 feet.

10. The driving range of claim 1, wherein at least one of said island greens is moveable.

11. A golf driving range for use with floating balls comprising:

a) a water reservoir having a front edge, a rear edge, and two side edges;

b) a plurality of practice tees along said front edge;

c) a plurality of island greens in said reservoir;

d) a pump system adjacent an edge of said reservoir to pump water onto the surface of water in said reservoir, said pump system including a pump, a water inlet conduit extending into said reservoir, and at least one water outlet conduit extending toward said reservoir; and e) a ball retriever adjacent an edge of said reservoir on the opposite side of said reservoir from said pump system, said water outlet conduit being positioned to project water substantially parallel to the surface of water in said conduit and generally in the direction of said ball retriever, whereby balls floating in said reservoir float toward, and are retrieved by, said ball retriever.

12. The driving range of claim 11, wherein said inlet conduit includes in inlet opening adjacent the bottom of said reservoir.

13. The driving range of claim 11, further including at least one ball dispenser for dispensing balls received by said ball retriever, said ball dispenser being in the vicinity of said practice tees.

14. The driving range of claim 11, wherein said ball retriever includes an inlet for receiving balls and water from said reservoir, a water discharge outlet for returning water to said reservoir, a separator adapted for separating said balls from said water, and a discharge conduit for discharging balls from said ball retriever.

15. The driving range of claim 11, wherein said pump system is positioned at the intersection of said rear edge and one of said side edges, and said ball retriever is positioned at the intersection of said front edge and the other of said side edges.

16. The driving range of claim 11, wherein said reservoir has a depth of from about 3.5 to about 5 feet, a width of from about 100 to about 150 yards, and a length of from about 250 to about 300 yards.

17. The driving range of claim 11 containing at least one additional component selected from the group consisting of a practice green, a practice sand trap, a club house, a parking lot, and a walkway to at least one of said island greens.

18. A method of retrieving floating golf balls hit into a body of water having a front edge, a rear edge, and two side edges comprising:

a) pumping water onto the surface of said body of water from the intersection of said rear edge and one of said side edges to cause said balls to float to the intersection of said front edge and the other of said side edges; and b) retrieving said balls at the intersection of said front edge and the other of said side edges.

19. The method of claim 18, further including the step of separating said water from said balls.

* * * * *